United States Patent [19]

Miller et al.

[11] Patent Number: 4,867,868

[45] Date of Patent: Sep. 19, 1989

[54] SELECTIVE FLOTATION OF INORGANIC SULFIDES FROM COAL

[75] Inventors: Kenneth J. Miller, Floreffe; Wu-Wey Wen, Murrysville, both of Pa.

[73] Assignee: The United States of America as represented by the Department of Energy, Washington, D.C.

[21] Appl. No.: 200,100

[22] Filed: May 31, 1988

[51] Int. Cl.[4] ..... B03D 1/02

[52] U.S. Cl. ..... 209/167; 44/622

[58] Field of Search ..... 209/166, 167; 252/61; 44/621, 622, 625, 627; 423/138, 461, 561 R

[56] References Cited

U.S. PATENT DOCUMENTS

| | | | |
|---|---|---|---|
| 2,636,604 | 4/1953 | Anderson | 209/166 |
| 3,807,557 | 4/1974 | Miller | 209/166 |
| 4,552,652 | 11/1985 | Attia | 209/167 |
| 4,615,712 | 10/1986 | Wen | 44/10 R |
| 4,632,750 | 12/1986 | McGarry | 209/166 |

OTHER PUBLICATIONS

Kirk Othmer Encyclopedia of Chem. Tech.-vol. 7, 530-539, published John Wiley & Sons, 1967.

Firth and Nicol, "The Influence of Humic Material on the Flotation of Coal", Int. Jour. of Min. Proc., 8 (1981), 239-248.

Laskowski et al, "Effects of Humic Acids on Coal Flotation", Coal Preparation 1986, vol. 3, pp. 133-154.

U.S. Dept. of Energy, @ Pgh, PA, "Quarterly Technical Progress Report"; period ending Sep. 30, 1986, pp. 88-89.

*Primary Examiner*—David L. Lacey

*Assistant Examiner*—Thomas M. Lithgow

*Attorney, Agent, or Firm*—High W. Glenn; Paul A. Gottlieb; Judson R. Hightower

[57] ABSTRACT

Pyritic sulfur is removed from coal or other carbonaceous material through the use of humic acid as a coal flotation depressant. Following the removal of coarse pyrite, the carbonaceous material is blended with humic acid, a pyrite flotation collector and a frothing agent within a flotation cell to selectively float pyritic sulfur leaving clean coal as an underflow.

8 Claims, 1 Drawing Sheet

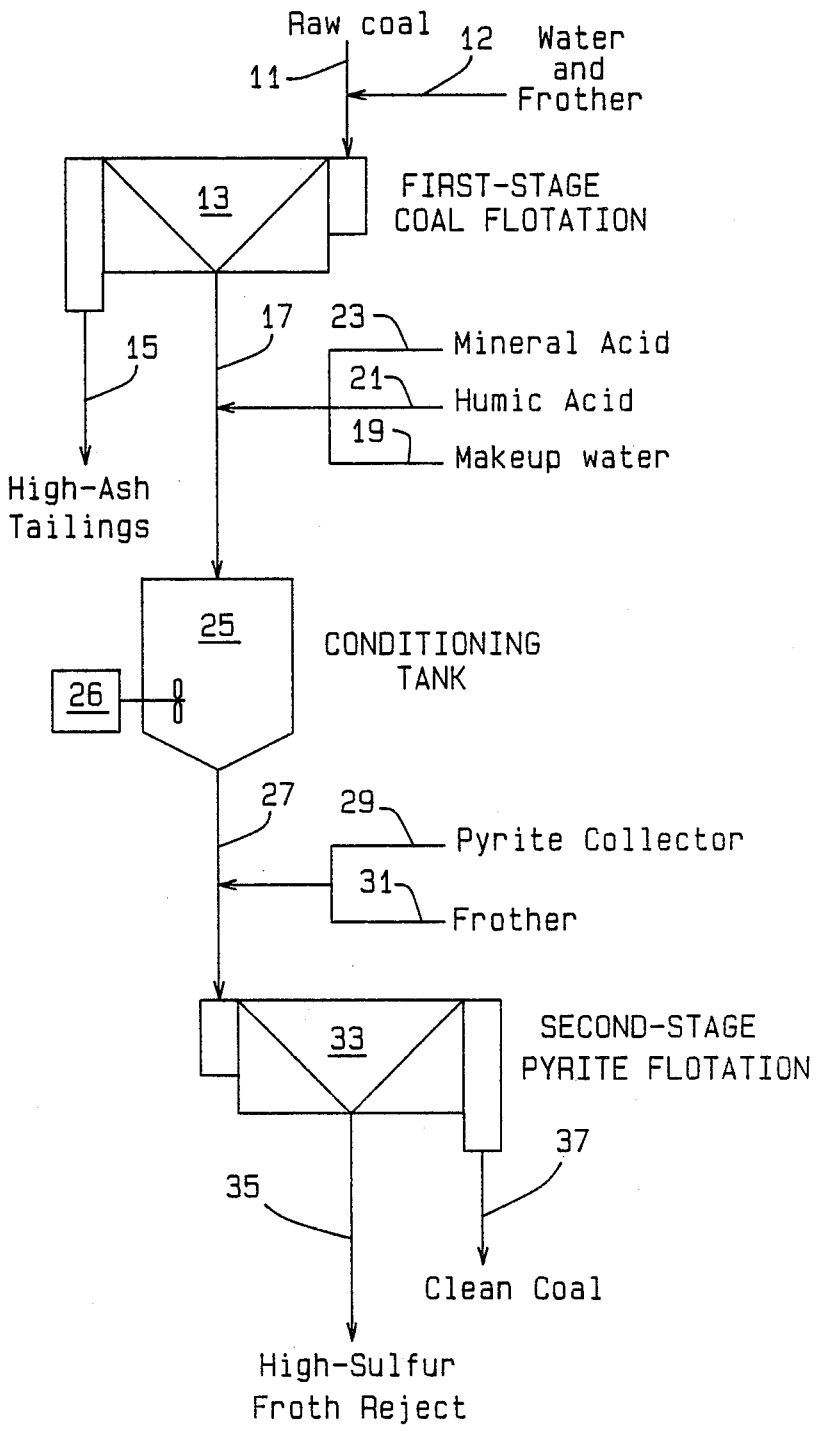
Raw coal
11
12
Water and Frother
13
FIRST-STAGE COAL FLOTATION
15
17
23
Mineral Acid
21
Humic Acid
19
Makeup water
High-Ash Tailings
25
CONDITIONING TANK
26
27
29
Pyrite Collector
31
Frother
33
SECOND-STAGE PYRITE FLOTATION
35
37
Clean Coal
High-Sulfur Froth Reject

SELECTIVE FLOTATION OF INORGANIC SULFIDES FROM COAL

CONTRACTUAL ORIGIN OF THE INVENTION

The United States Government has rights in this invention pursuant to the employer-employee relationship of the U.S. Department of Energy and the inventors.

BACKGROUND OF THE INVENTION

This invention relates to a method of separating inorganic sulfides from carbonaceous material such as coal, coke, oil shale, and other carbonaceous products. Inorganic sulfides include pyritic sulfur, that is sulfur in the form of pyrite or marcasite. For the most part, $FeS_2$ makes up about 40–80% of the total sulfur in coal with the remaining sulfur combined with organic compounds.

The inorganic sulfur is present in macroscopic and microscopic forms. Consequently, physical separation of pyritic sulfur from coal has required crushing to a very fine size in order to liberate the microscopic pyrite which may be contained in domains as small as one or two microns in diameter. Ordinary, specific gravity separations have been effective only to remove the coarser pyritic sulfur from coal and other carbonaceous materials.

One approach in overcoming these problems is described in U.S. Pat. No. 3,807,557 to Miller, one of the present co-inventors. Finely divided coal is formed into an aqueous pulp and subjected to froth flotation to float and remove most of the carbonaceous material from the coarse pyritic material in the underflow. The underflow also contains clay and mineral shale. The carbonaceous material in the froth is repulped, conditioned with a coal flotation depressant and a pyrite flotation collector to float the fine-size pyrite while removing the coal product as underflow in the second flotation stage.

Coal flotation depressants have been selected from organic colloids, for instance a carbohydrate such as dextrin or modified carbohydrates, i.e., modified corn or potato starch. Other colloid depressants include proteinaceous material, such as glue, gelatin, albumin, casein or whey. In addition, a complex polyhydroxycarboxylic acid or a gluccide of high molecular weight such as quebracho extract, tannin, or saponin have been suggested. A convenient source of coal depressant is Aero Depressant 633, a modified soluble carbohydrate available from the American Cynamide Company.

The high costs of these depressants and agents used in the earlier processes have made the two stage flotation process for removing sulfur from coal uncompetitive with the current practices involving use of low sulfur coal, petroleum fuel and other low-sulfur fuels.

Therefore, in view of these considerations, it is an object of the present invention to provide an improved process for removing pyritic sulfur from coal.

It is a further object to provide a method for depressing carbonaceous material during pyrite flotation through the use of a coal derived depressant.

It is also an object to provide a coal depressant that is derived from coal or other carbonaceous materials.

SUMMARY OF THE INVENTION

In accordance with the present invention, a method is provided for removing pyritic sulfur from carbonaceous material. The method includes forming a carbonaceous material into an aqueous pulp containing a pyrite flotation collector. Humic acid is added to the pulp and the pulp is frothed to collect a fraction in the froth, rich in pyritic sulfur, and leave an underflow fraction of aqueous carbonaceous pulp with reduced pyritic sufur as product. In most instances, the carbonaceous pulp also will have a reduced ash concentration.

In other aspects of the invention, the humic acid is added into the aqueous pulp at a level of at least 0.05 lbs. per ton of carbonaceous material. Preferrably about 0.3 to 1.2 lbs. of humic acid are added for each ton of carbonaceous material treated.

In an important aspect of the invention, the pH of the aqueous pulp is adjusted to be less than 4.5, preferably about 2 to 4, to effectively depress a coal or carbonaceous material while selectively floating pyritic sulfur-containing materials.

This invention also involves the removal of inorganic sulfur from carbonaceous material by forming an aqueous pulp of the carbonaceous material in a finely divided state followed by a froth flotation of the pulp to selectively float carbonaceous material from coarse inorganic sulfur-containing particles. The floating froth of carbonaceous material is removed and repulped with water to form a second aqueous pulp. The pulp is frothed at a pH of less than 4.5 with the addition of a collector to float inorganic sulfur-containing material and with the addition of humic acid to depress flotation of the carbonaceous material. The froth of the second pulp bearing concentrated inorganic sulfur-containing materials is withdrawn leaving the non-floating carbonaceous material with reduced sulfur content.

DETAILED DESCRIPTION OF THE DRAWING

The single FIGURE is a schematic flow diagram illustrating one embodiment of the present invention.

DETAILED DESCRIPTION OF THE PREFERRED EMBODIMENT

One manner of carrying out the present invention is illustrated in the FIGURE. An initial separation is conducted to remove some of the high-sulfur material, such as coarse pyrite from the carbonaceous material. This initial separation can be a procedure such as the first stage of the two stage flotation process of U.S. Pat. No. 3,807,557 cited above and herein incorporated by reference for this purpose.

Coal 11, water and frother 12 are mixed within a preliminary flotation cell 13 to form an aqueous pulp. Coarse pryrite and mineral ash are removed as underflow tailings 15 while coal is removed with the floating froth 17 for further cleaning.

In the process of the present invention, froth 17 along with make up water 19, humic acid 21 and mineral acid 23 are passed to a conditioning tank 25 for thorough mixing with agitator 26 to form a second coal-water pulp. The pH of the pulp is adjusted to a level substantially lower than that ordinarily used in a conventional coal-pyrite flotation process. This conditioning step brings the humic acid into contact with the coal particles to depress their ability to float in the second flotation stage.

The conditioned pulp 27 is combined with a pyrite collector 29 and a frothing agent 31 in a second flotation cell 33. The floating froth 35 containing high sulfur pyritic and the underflow 37 including the clean coal are removed as separate streams from the flotation cell 33.

It is preferred that a minimum amount of frothing agent be included, typically about 0.001 by weight or less. Suitable frothers include those commonly used in the froth flotation of coal and minerals. For example, pine oil, aliphatic alcohols, particularly methyl isobutyl carbonol (MIBC) and 2-ethylisohexanol.

In addition to the preliminary separation by conventional froth flotation, other preliminary separations can be used such as separations by size and by specific gravity to select a low-ash and low-sulfur fraction. Jigs for differential settling and cyclones can be employed to remove ash and coarse pyrite. Such processes are well adapted for effecting a preliminary cleaning of coal and other carbonaceous material. Although, it is preferred that an initial separation or cleaning be made, applicants process also can be used on raw coal or various other carbonaceous materials that do not contain large amounts of coarse pyritic sulfur or ash.

The flotation of the froth in each of the flotation cells can be performed with aeration typically at a flow rate of 0.3 to 1.2 cubic feet of air per minute per gallon of slurry for about 1 to 3 minutes. Scrapers or paddles are used for removing the forth containing the overflow material.

Typically, a sufficient water is added to the carbonaceous material to form a pulp of about 3–20% solids in the flotation cells. For convenience and operational efficiency the pulp ordinarily will be about 5–15% by weight solids.

In the process of this invention, the pulp is conditioned with humic acid to depress the flotation of the carbonaceous material and with a mineral acid to adjust pH prior to the second stage flotation. It is expected that at least 0.05 pounds of humic acid per ton of carbonaceous material should be provided to effectively suppress flotation. More particularly, humic acid at a level of about 0.3 to 1.2 pounds per ton of carbonaceous material is preferred.

The inventors have found that in order to selectively float the pyritic sulfur from the carbonaceous material with humic acid as a flotation depressant, that a pH substantially lower than that used with a conventional coal depressant is preferred. Although, some separation can be obtained with a pH as high as 6, it is of considerable advantage to use a pH of less than 4.5. As will be seen below a pH of 2–4 is preferred. Prior to the inventors' discovery, humic acid at these low pH levels had not been recognized as a suitable depressant for coal or other carbonaceous material in a process for the selective flotation of pyritic sulfur.

Humic acid for this purpose can be prepared substantially in the same manner as that disclosed in U.S. Pat. No. 4,615,712 to Wen, one of the present co-inventors. This earlier patent by Wen is expressly incorporated by reference herein for its teachings of humic acid preparation. A carbonaceous material such as coal or lignite is oxidized by contact with air or other active oxidizing agents such as hydrogen peroxide, sulfuric acid, nitric acid, potassium permanganate or potassium dichromate. Leonardite, a naturally occurring, oxidized lignite also may be used. Humate solutes are extracted from the oxidized carbonaceous material by means of an aqueous alkaline solution such as sodium hydroxide or ammonia hydroxide. The humic acid extract is blended into the coal pulp and the pH adjusted as discussed above. Hydrochloric, nitric, sulfuric or other mineral acid can be used to adjust pH.

In addition to the humic acid, about 0.001 to 0.005 weight percent of a pyrite flotation collector is blended into the pulp within the flotation cell. The collector can be a xanthate of potassium or sodium, such as potassium amyl xanthate or other xanthates such as sodium isobutyl xanthate and sodium isopropyl xanthate. MIBC or other frothing agent in the amount of about 0.001 weight percent or less is used prior to aeration to effect the selective flotation of the pyritic sulfur compounds.

The invention is specifically illustrated by laboratory flotation tests conducted with Upper Freeport coal crushed to approximately 30 U.S. standard mesh and previously cleaned by froth flotation to remove a portion of the mineral ash and pyritic sulfur. The partially cleaned coal was subjected to the selective flotation of pyritic sulfur, leaving behind an underflow of clean coal. Table I provides details of these coal-pyrite flotation results at differing levels of humic acid and slurry pH. Potassium amyl xanthate was used as the pyrite flotation collector at about 1.2 lbs. per ton of feed.

TABLE I

| | | | Analyses, % | | | |
|---|---|---|---|---|---|---|
| Slurry pH | Humic Acid addition, lb/ton | Product Description | Weight | Ash | Pyrite Sulfur | Total Sulfur |
| 2.0 | 0.3 | Underflow clean coal | 78.9 | 9.21 | 0.47 | 1.19 |
| | | Froth reject | 21.1 | 6.58 | 0.84 | 1.75 |
| | | Feed | 100.0 | 8.66 | 0.55 | 1.31 |
| | 0.6 | Underflow clean coal | 92.6 | 8.05 | 0.52 | 1.26 |
| | | Froth reject | 7.4 | 6.34 | 0.92 | 1.90 |
| | | Feed | 100.0 | 7.92 | 0.55 | 1.31 |
| | 1.2 | Underflow clean coal | 97.2 | 8.00 | 0.54 | 1.29 |
| | | Froth reject | 2.8 | 6.39 | 1.13 | 2.15 |
| | | Feed | 100.0 | 7.95 | 0.56 | 1.31 |
| 3.0 | 0.3 | Underflow clean coal | 55.5 | 9.47 | 0.23 | 0.99 |
| | | Froth reject | 44.5 | 5.94 | 0.93 | 1.80 |
| | | Feed | 100.0 | 7.90 | 0.54 | 1.35 |
| | 0.6 | Underflow clean coal | 96.5 | 7.66 | 0.26 | 1.04 |
| | | Froth reject | 3.5 | 12.18 | 4.81 | 6.37 |
| | | Feed | 100.0 | 7.82 | 0.42 | 1.23 |
| | 1.2 | Underflow clean coal | 99.3 | 7.66 | 0.35 | 1.09 |
| | | Froth reject | 0.7 | 18.42 | 17.20 | 18.29 |
| | | Feed | 100.0 | 7.74 | 0.47 | 1.21 |
| 4.0 | 0.3 | Undeflow clean coal | 82.8 | 8.15 | 0.21 | 0.95 |
| | | Froth reject | 17.2 | 9.11 | 2.76 | 4.05 |
| | | Feed | 100.0 | 8.32 | 0.65 | 1.48 |

TABLE I-continued

| Slurry pH | Humic Acid addition, lb/ton | Product Description | Analyses, % Weight | Ash | Pyrite Sulfur | Total Sulfur |
|---|---|---|---|---|---|---|
| | 0.6 | Underflow clean coal | 92.0 | 7.87 | 0.25 | 1.01 |
| | | Froth reject | 8.0 | 7.02 | 1.70 | 2.53 |
| | | Feed | 100.0 | 7.80 | 0.37 | 1.13 |
| | 1.2 | Underflow clean coal | 86.5 | 8.84 | 0.31 | 1.09 |
| | | Froth reject | 13.5 | 8.65 | 2.20 | 3.13 |
| | | Feed | 100.0 | 8.81 | 0.56 | 1.37 |

As discussed above, when humic acid is used as a flotation depressant for carbonaceous material, the pH of the pulp must be substantially lower than with other flotation depressants. Although some separation can be obtained at pH levels as high as 6 it is of considerable advantage to use a pH of less than 4.5 in the inventors' process. More particularly, a pH of 2–4 is preferred. At higher pH levels, the separations are less effective and larger fractions of the carbonaceous material enter the froth reject.

In Table II, the results of second stage flotation at higher pH levels are given. Humic acid and potassium amyl xanthate each were added at a level of about 1 lb. per ton of coal feed to the second stage. Pittsburgh Coal at under 30 U.S. Standard Mesh was treated by conventional froth flotation in the first stage to remove mineral ash and some of the pyritic sulfur prior to becoming the second stage feed.

TABLE II

Coal-Pyrite Flotation

| Slurry pH | Product Description | Weight | Ash | Total Sulfur |
|---|---|---|---|---|
| 4.0 | Underflow clean coal | 97.8 | 5.2 | 1.71 |
| | Froth reject | 2.2 | 16.3 | 11.15 |
| | Feed | 100.0 | 5.4 | 1.92 |
| 4.5 | Underflow clean coal | 96.9 | 4.9 | 1.69 |
| | Froth reject | 3.1 | 13.0 | 7.92 |
| | Feed | 100.0 | 5.2 | 1.88 |
| 5.0 | Underflow clean coal | 94.6 | 5.1 | 1.81 |
| | Froth reject | 5.4 | 8.7 | 4.51 |
| | Feed | 100.0 | 5.3 | 1.96 |
| 6.0 | Underflow clean coal | 78.0 | 5.4 | 1.85 |
| | Froth reject | 22.0 | 6.5 | 2.54 |
| | Feed | 100.0 | 5.6 | 2.00 |
| 7.0 | Underflow clean coal | 61.1 | 5.6 | 1.85 |
| | Froth reject | 38.9 | 4.5 | 1.97 |
| | Feed | 100.0 | 5.2 | 1.90 |
| 8.0 | Underflow clean coal | 47.4 | 7.2 | 1.93 |
| | Froth reject | 52.6 | 4.2 | 1.90 |
| | Feed | 100.0 | 5.6 | 1.91 |
| 9.0 | Underflow clean coal | 50.0 | 6.7 | 1.88 |
| | Froth reject | 50.0 | 4.4 | 1.89 |
| | Feed | 100.0 | 5.6 | 1.89 |

It is seen that the present method provides an effective process for the removal of mineral ash and pyritic sulfur from coal and other carbonaceous materials. Humic acid, a product of oxidized coal, can be employed as an economical coal flotation depressant at a pH much lower than would be expected from prior froth flotation processes and processes for the extraction of humic acid from carbonaceous material.

Although the invention has been described in terms of specific agents and process steps, it will be understood by one skilled in the art that various changes and modifications may be made in accord with the invention defined in the accompanying claims.

The embodiment of the invention in which an exclusive property or privilege is claimed is defined as follows:

1. A method of removing pyritic sulfur from carbonaceous material containing said pyritic sulfur comprising:

forming the carbonaceous material into an aqueous pulp containing a a frothing agent;

conditioning said pulp by mixing with humic acid and mineral acid in an amount sufficient to reduce its pH and to depress the floatability of said carbonaceous material;

further conditioning by adding a pyrite collector and additional frothing agent to the conditioned pulp;

subjecting said further conditioned pulp at a pH of 2–4 to froth flotation to collect a fraction in the froth rich in pyritic sulfur and leave a fraction in the aqueous pulp with reduced pyritic sulfur.

2. The method of claim 1 wherein said pyrite collector is an alkali metal xanthate.

3. The method of claim 1 wherein said humic acid is added to said aqueous pulp in an amount of at least 0.05 lbs/ton of carbonaceous material.

4. The method of claim 3 wherein said humic acid is added to said aqueous pulp in an amount of about 0.3 to 1.2 lbs/ton of carbonaceous material.

5. The method of claim 1 wherein said carbonaceous material is of less than 30 U.S. Standard Mesh.

6. The method of claim 1 wherein said carbonaceous material is formed into an aqueous pulp containing a frothing agent by comminuting said carbonaceous material to less than 30 U.S. Standard Mesh, adding water and frothing agent to form a slurry and subjecting the slurry to an initial froth flotation separation to remove a portion of the pyritic sulfur prior to conditionng said pulp with humic acid.

7. A method of removing inorganic sulfur from carbonaceous material containing said inorganic sulfur comprising:

forming a first aqueous pulp containing a frothing agent and the carbonaceous material in finely divided state; subjecting said first pulp to a first froth flotation step to selectively float and separate partially cleaned, carbonaceous material from a portion of the inorganic sulfur;

removing and repulping the partially cleaned carbonaceous material to form a second aqueous pulp;

conditioning the second aqueous pulp by mixing with humic acid and mineral acid in an amount sufficient to reduce its pH and to depress the flotation of said partially cleaned carbonaceous material;

subjecting the conditioned second pulp at a pH of 2–4 to froth flotation with the addition of a flotation collector of inorganic sulfur; and withdrawing the second pulp froth with concentrated inorganic sulfur and leaving the depressed carbonaceous material with reduced sulfur content.

8. The method of claim 7 wherein said humic acid is added to about 0.3 to 1.2 lbs per ton of carbonaceous material.

* * * * *